US005944387A

United States Patent [19]

Stumpf

[11] Patent Number: 5,944,387

[45] Date of Patent: Aug. 31, 1999

[54] ADJUSTMENT MECHANISM FOR CHAIRS

[75] Inventor: William S. Stumpf, Waterloo, Canada

[73] Assignee: Northfield Metal Products Ltd., Waterloo, Canada

[21] Appl. No.: 09/072,266

[22] Filed: May 4, 1998

[51] Int. Cl.[6] ..... A47C 7/54

[52] U.S. Cl. ..... 297/411.37; 297/411.26

[58] Field of Search ..... 297/411.35, 411.37, 297/411.36, 383, 353, 411.26

[56] References Cited

U.S. PATENT DOCUMENTS

| | | | |
|---|---|---|---|
| 4,043,592 | 8/1977 | Fries | 297/291 |
| 4,139,235 | 2/1979 | Elbert | 297/284 |
| 4,478,456 | 10/1984 | Mitsui | 297/410 |
| 4,483,565 | 11/1984 | Terui et al. | 297/410 |
| 4,660,885 | 4/1987 | Suhr et al. | 297/353 |
| 4,662,681 | 5/1987 | Favaretto | 297/349 |
| 4,662,682 | 5/1987 | Maurel | 297/353 |
| 5,007,678 | 4/1991 | DeKraker | 297/353 |
| 5,324,096 | 6/1994 | Schultz | 297/411.36 |
| 5,338,133 | 8/1994 | Tornero . | |
| 5,462,338 | 10/1995 | Baumann . | |

FOREIGN PATENT DOCUMENTS

| | | |
|---|---|---|
| B-76302/91 | 11/1992 | Australia . |
| 8304246 | 7/1985 | Netherlands . |

OTHER PUBLICATIONS

Chair Armrest Adjustment Mechanism; Global Upholstery Company of Downsview, Ontario, Canada; May 1997; photographs and physical specimen.

*Primary Examiner*—Milton Nelson, Jr.
*Attorney, Agent, or Firm*—Wood, Herron & Evans, LLP

[57] ABSTRACT

A chair armrest bar is horizontally slidably received in a channel of a base attached to a chair seat. The base defines longitudinally arranged interconnected slots in its bottom wall. A locking lever is pivotably mounted to the armrest bar. The lever has a locking pin which is biased into one of the slots to lock the armrest in position; the lever may be tilted to an unlocking position to allow the bar to slide. The lever is releasably attached to the bar by a mount so that the lever may be removed to allow replacement of the bar.

14 Claims, 4 Drawing Sheets

ADJUSTMENT MECHANISM FOR CHAIRS

FIELD OF THE INVENTION

This invention relates to an adjustment mechanism for a chair allowing relative displacement of two chair parts. In a preferred form, the invention provides horizontally adjustable armrests for chairs.

BACKGROUND OF THE INVENTION

It is known to provide stepwise adjustment mechanisms for chairs. For example, in U.S. Pat. No. 4,662,682 to Maurel, the chair base has a notched arm which may receive teeth extending from a plunger supported on the chair backrest to adjustably lock the backrest in place. A similar arrangement with a toothed lever in place of a plunger is shown in U.S. Pat. No. 4,139,235 to Elbert. In U.S. Pat. No. 4,043,592 to Fries, a pin extends from the arm of the chair back, while a notched pin latching lever is carried by a backrest bracket.

A horizontal adjustment mechanism for armrests is disclosed in U.S. Pat. No. 4,662,681 to Favaretto. The armrests of the chair are bolted onto the bottom of the seat portion of the chair and are adjustable by loosening the bolts which sit in slots, moving the armrest so that the bolts slide along the slots, and then tightening the bolts again.

Australian Patent AU-B-76302 to Ryner teaches a vertical armrest adjustment mechanism with a locking pin spring biased into one of a series of overlapping slots to lock the armrest in position.

Known adjustment mechanisms suffer from one or more of the following drawbacks. They may not allow for adjustment horizontally. They may require many parts and are often difficult to manufacture and difficult to operate. Many cannot be adjusted by the operator of the chair while seated in the chair. Many of the devices do not permit easy disassembly for maintenance, field repair or replacement. Because it is often difficult to take the mechanism apart, many of such devices do not permit adapting the chair for different user requirements. Further, many of the devices are bulky, which is problematic where a mechanism is mounted under the seat since, due to the many desirable adjustment mechanisms which must be accommodated under the seat, space is scarce.

SUMMARY OF THE INVENTION

It is an aspect of the present invention to provide a chair adjustment mechanism which has few parts, is easy to manufacture, is easy to operate by the occupant and requires little space. Preferably the occupant need not get out of the chair to adjust the position of the adjustable parts. The adjustment mechanism may be easily disassembled, allowing for easy replacement, repair or maintenance. Additionally, should the occupant require, for example, extra width, the adjustment mechanism can easily be removed and an extended section substituted.

According to an aspect of the present invention, there is provided an adjustment mechanism for a chair comprising: a base; an adjustable member; one of said base and said adjustable member defining a channel, the other of said base and said adjustable member comprising a bar slidably received by said channel; a locking lever pivotally mounted to a mount; a releasable attachment releasably attaching said mount to said bar; one of said base and said locking lever having a plurality of slots arranged longitudinally; the other of said base and said locking lever having a locking pin configured for locking reception in one of said slots when said locking lever is in a locking position; and a resilient member to bias said lever towards said locking position.

DESCRIPTION OF THE DRAWINGS

The present invention will be described in detail with reference to the accompanying drawings, in which like numerals denote like parts in the several views, and in which.

DETAILED DESCRIPTION OF THE PREFERRED EMBODIMENTS

Figure 1:
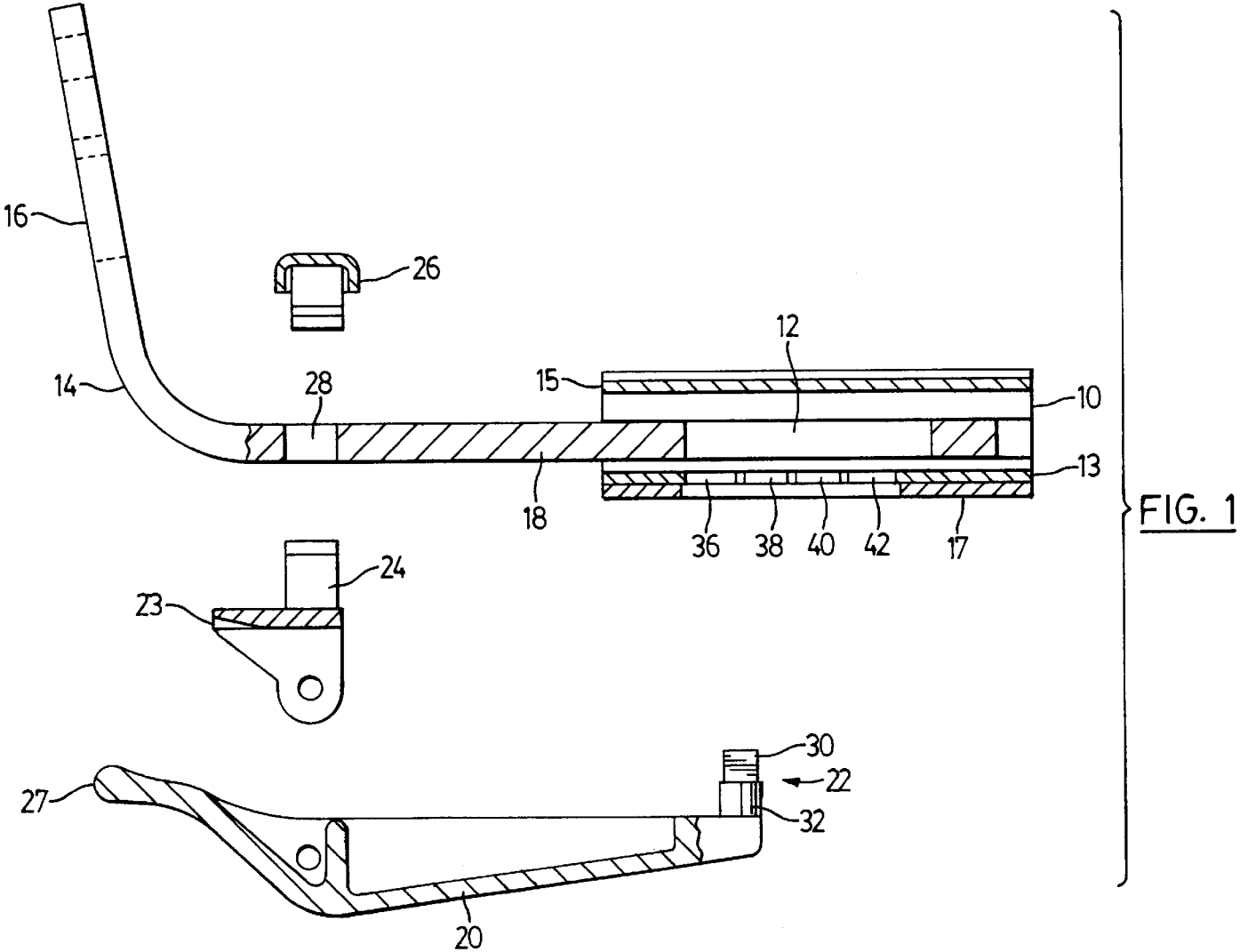
FIG. 1 is an exploded cross section of an arm rest adjustment mechanism made in accordance with this invention.
Figure 2:
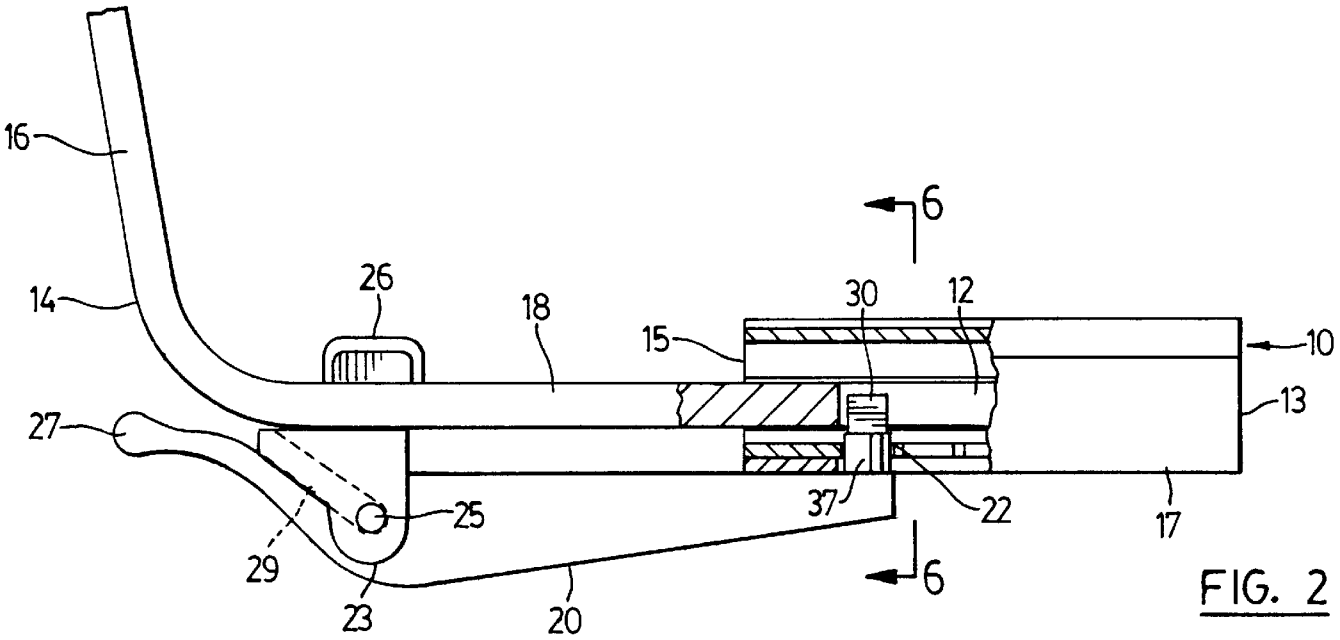
FIG. 2 is a side elevation of the armrest adjustment mechanism of FIG. 1 in part section in a locked position
Figure 3:
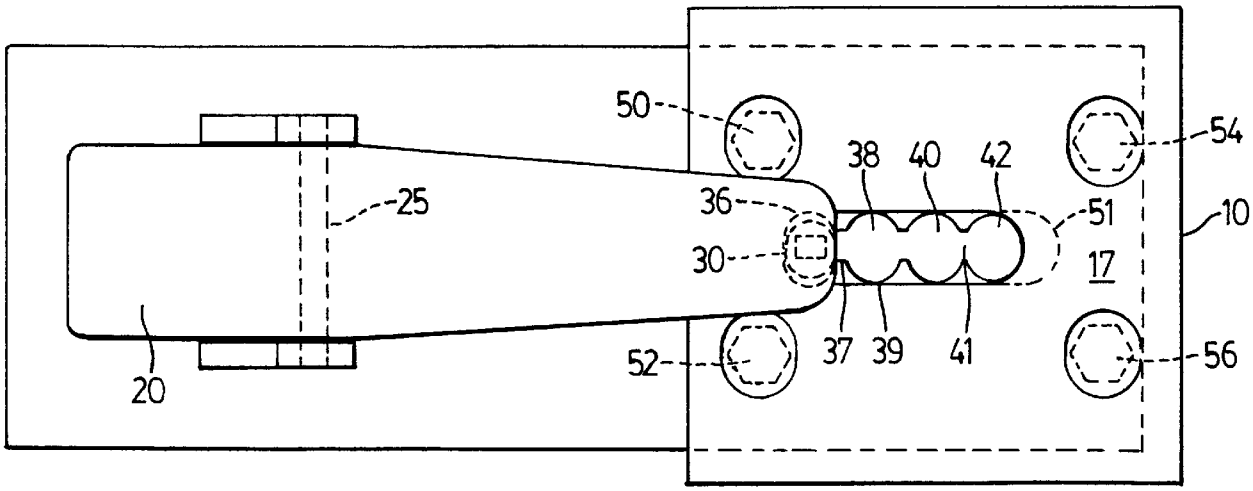
FIG. 3 is a bottom view of the mechanism of FIG. 2.

Turning to FIGS. 1 to 3, a base 10 is attached by bolts 50, 52, 54, 56 to the seat of a chair (not shown). The base defines a channel 12 extending between the ends 13, 15 of the base and longitudinally arranged interconnected slots 36, 38, 40, 42, which extend through the bottom wall 17 of the base. An armrest bar 14 has a vertical portion 16 for attaching to a chair armrest (not shown), and a horizontal portion 18 which is inserted in the channel 12 of the base 10.

A locking lever 20 having a locking pin 22 proximate one end and a handle 27 proximate the other end is pivotally connected to the armrest bar 14 by a mount 23 and a shaft 25 (FIG. 2). The shaft extends through the locking lever 20 and mount 23. The mount 23 has a post 24 which protrudes through an aperture 28 in the armrest bar 14 and is held in place by a cap 26. The post 24, aperture 28 and cap 26 preferably have complementary square or rectangular cross sections. The locking lever 20 is biased to a locked position, as shown in FIG. 2 by a leaf spring 29 extending around shaft 25.

Figure 5:
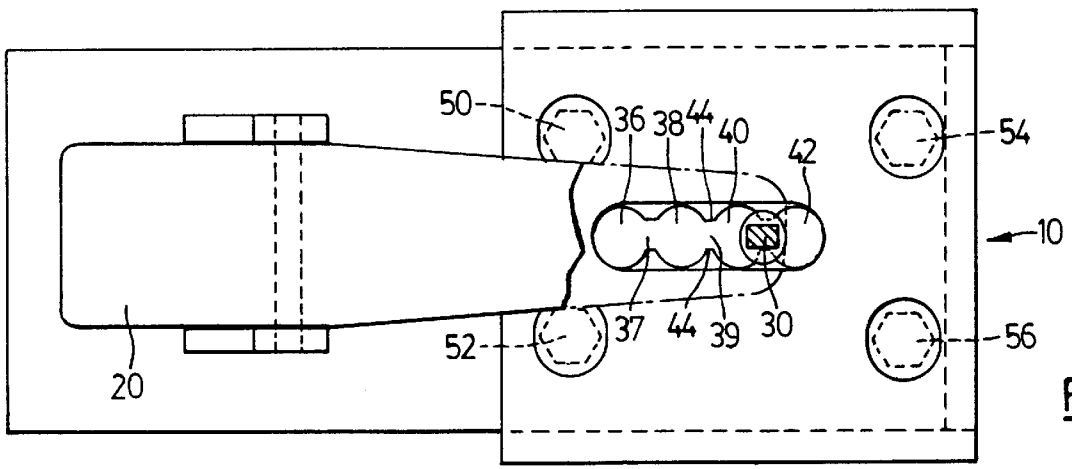
FIG. 5 is a bottom view of the mechanism of FIG. 4, partly broken away and part sectioned.

The locking pin 22 has a locking portion 32 with a shape complementary to that of slots 36, 38, 40, 42 and a guide portion 30 with a rectangular cross section (seen in FIG. 5).

Figure 6:
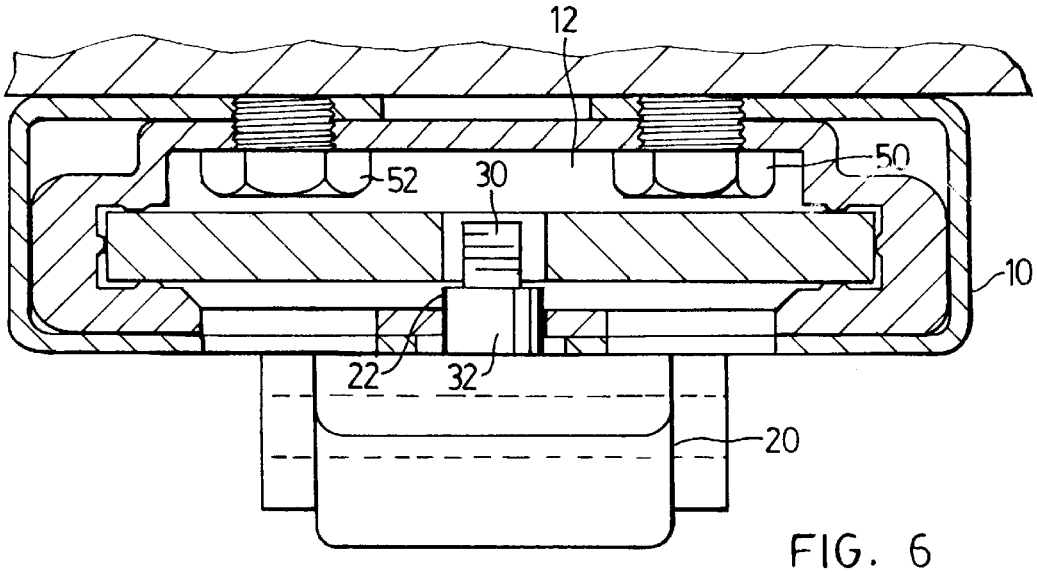
FIG. 6 is an enlarged cross section at view taken along the lines 6—6 of FIG. 2.

As seen in FIG. 3, the slots 36, 38, 40, 42 have circular outlines interrupted by parallel-sided guide channels 37, 39, 41 which interconnect the slots. In the locked position illustrated in FIGS. 2 and 6, the locking portion 32 of the locking pin 22 is received in one of the slots 36, 38, 40, 42 thereby locking the armrest bar 14 from horizontal movement with respect to the base 10. In the embodiment illustrated, the locking pin 22 protrudes into the channel 12 and also partially through an elongated aperture 51 in the armrest bar 14.

Figure 4:
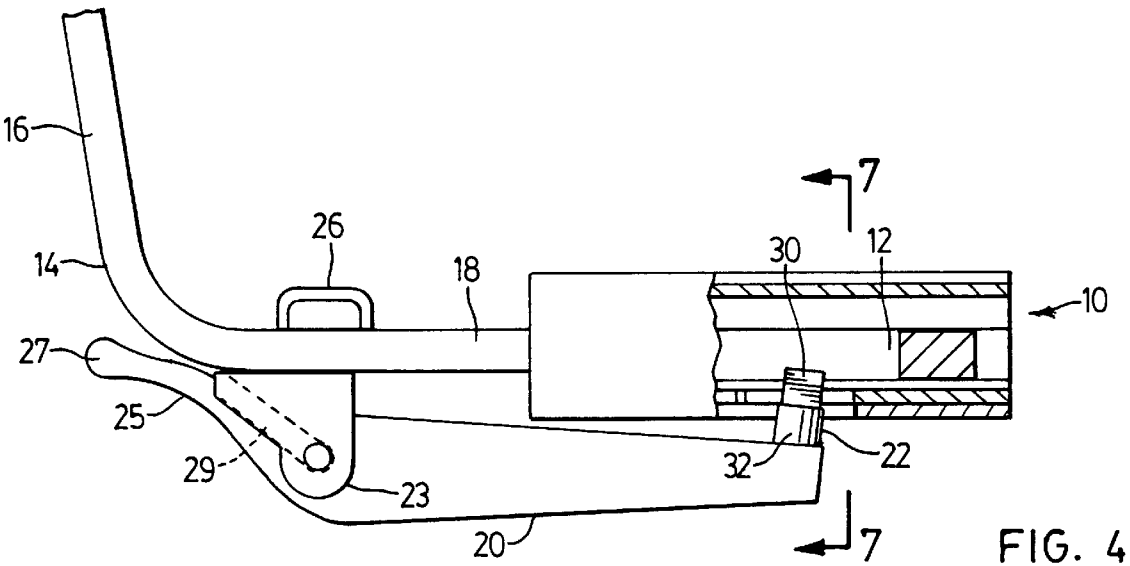
FIG. 4 is a side elevation of the armrest adjustment mechanism of FIG. 1 in part section in an unlocked position.
Figure 7:
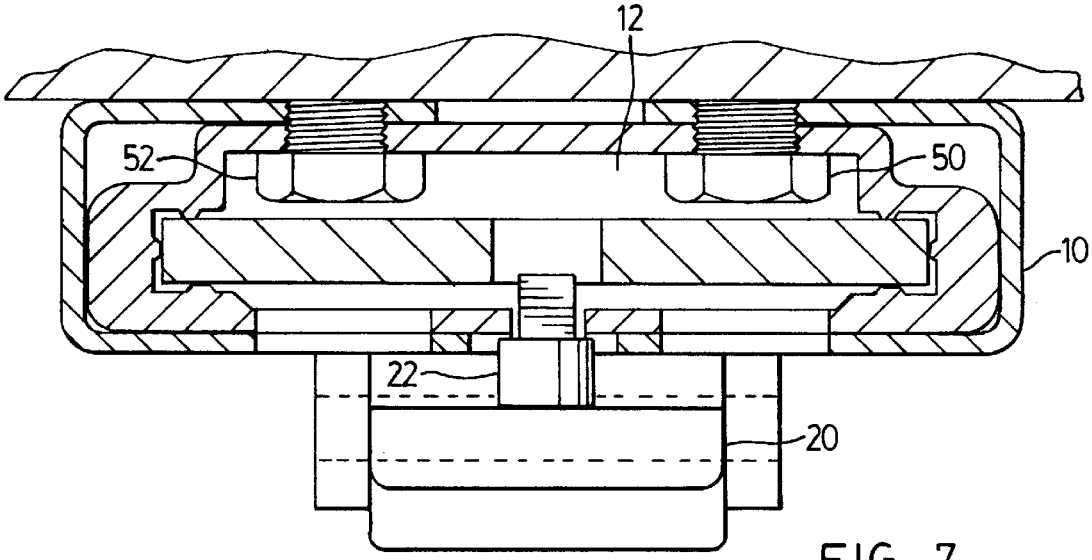
FIG. 7 is an enlarged cross section at view taken along the lines 7—7 of FIG. 3.

When the handle 27 of lever 20 is pulled towards the armrest bar 14 as shown in FIGS. 4 and 7, the locking lever tilts such that the locking portion 32 of the locking pin disengages from the slot it was received in and the guide portion 30 of locking pin 22 drops into this slot. The guide portion 30 is sized to pass along guide channels 37, 39, 41 thereby permitting the armrest bar to be slid horizontally between end most slots 36 and 42. On the other hand because the guide portion 30 protrudes into one of the slots 36, 38, 40, and 42 and/or guide channels 37, 39, 41 in the unlocked position, the locking pin 22 prevents the armrest bar 14 from being completely pulled out of the channel 12. The width of guide channels 37, 39, 41 is slightly wider than the width of the guide portion 30 of the locking pin 22, which reduces lateral play of the locking lever 20 and, therefore, of the armrest bar, while the locking pin is travelling to a new slot. This lateral restriction is shown in FIGS. 5 and 7.

The use of lever 20 removes part of the adjustment mechanism from under base 10 and from under the seat of a chair which is advantageous given the space limitations which are typical under the seat of an adjustable chair. Further, as seen in FIG. 3 and 5, the lever may have a narrow width under the chair which further conserves space.

Figure 8:
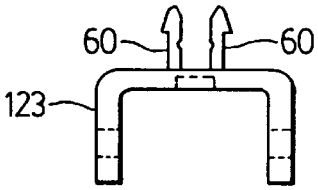
FIG. 8 is a front view of a portion of FIG. 1.

The cap 26 may be joined to the post 24 of mount 23 in any suitable manner to releasably secure the mount to the armrest bar. For example, the cap may be a press fit cap which is press fit onto the post or the cap may be screwed on the post, where the cap and post have a circular cross-section and are threaded. Additionally, the protruding portion of the post may have a through hole for receiving a cotter pin. As a further option as illustrated in FIG. 8, the post of mount 123 may be provided with spring fingers 60 which snap fit into the cap. Instead of a cap, the post may have a circumferential notch for receiving a circlip. Each of these releasable attachments (cap, cotter pin, circlip) hold the mount against the bottom face of the armrest bar by reason of the releasable attachment bearing against the top surface of the bar.

Instead of providing interconnected slots in the base and the locking pin on the locking lever, the locking pin may extend from the base and the slots may be provided in the locking lever.

In the preferred embodiment, the slots are circular, but the slots could be for example be oval, square, or triangular. Preferably the locking portion of the locking pin has a complementary shape to that of the slots, however, all that is necessary is that the locking portion have a greater width than that of the guide channels.

It is not necessary for the lever to be biased to the locked position by a leaf spring. Any type of spring or other resilient member which maintains the required bias is acceptable.

The armrest bar 14 may be removed by first removing the cap 26 from the post 24 of mount 23. This allows removal of the locking lever which withdraws the locking pin of the lever 20 from the slots/guide channels in the base. The armrest bar can then be withdrawn from the channel 12 in the base 10. Field repair is therefore facilitated. Also, if size adjustment is needed, a new armrest bar can be provided, which has the required length or height.

The foregoing description is illustrative of the preferred embodiments only and is not to be considered limiting. As various alternatives, modifications and variations of the present invention will occur to those skilled in the art, it will be understood that the present invention extends fully to such equivalents and is to be limited in scope only as recited in the appended claims, and structural and functional equivalents thereof.

What is claimed is:

1. An adjustment mechanism for a chair comprising:

a base;

an adjustable member;

one of said base and said adjustable member defining a channel, the other of said base and said adjustable member comprising a bar slidably received by said channel;

locking lever pivotally mounted to a mount;

a releasable attachment releasably attaching said mount to said bar;

one of said base and said locking lever having a plurality of slots arranged longitudinally;

the other of said base and said locking lever having a locking pin configured for locking reception in one said slots when said locking lever is in a locking position; and a resilient member to bias said lever towards said locking position, and wherein said bar defines an aperture and wherein said mount comprises a post received by said aperture and joined to said releasable attachment.

2. The adjustment mechanism of claim 1 wherein a portion of said mount abuts a face of said bar, said post protrudes through said bar past an opposite face of said bar and said releasable attachment is joined to a protruding end of said post and bears against said opposite face.

3. The adjustment mechanism of claim 2 wherein said releasable attachment comprises a cap adapted for engaging said protruding end of said post.

4. The adjustment mechanism of claim 3 wherein said post terminates in spring fingers to which said cap snaps.

5. The adjustment mechanism of claim 4 wherein said aperture in said bar, said post and said cap have square cross sections.

6. The adjustment mechanism of claim 2 where said base defines said slots and said locking lever comprises said locking pin.

7. The adjustment mechanism of claim 6 wherein said slots are longitudinally arranged and interconnected by guide channels.

8. The adjustment mechanism of claim 7 where said locking pin has a guide portion with a rectangular cross section having a width smaller than a width of said guide channels, said guide portion being within said slots when said locking lever is in an unlocking position such that said guide portion is slidable between slots through said guide channels.

9. The adjustment mechanism of claim 7 wherein said slots comprise a plurality of longitudinally arranged circular apertures interrupted by parallel-sided guide channels.

10. The adjustment mechanism of claim 7 wherein the locking pin has a locking portion having a shape complementary to that of said slots, said locking portion received by one of said slots when said locking lever is in said locking position.

11. The adjustment mechanism of claim 10 where said resilient member is a leaf spring.

12. A horizontal adjustment mechanism for a chair armrest, comprising:

a base for attachment to a chair seat, said base defining a channel;

an armrest bar slidably received by said base channel;

a locking lever pivotally mounted to a mount;

a releasable attachment releasably attaching said mount to said armrest bar;

said base defining a plurality of longitudinally arranged slots;

said locking lever having a locking pin configured for locking reception in one of said slots when said locking lever is in a locking position; and a resilient member to bias said lever towards said locking position.

13. The horizontal adjustment mechanism of claim 12 wherein said bar defines an aperture and wherein said mount comprises a post protruding through said aperture and joined to said releasable attachment.

14. The horizontal adjustment mechanism of claim 13 wherein said releasable attachment bears against a top surface of said armrest bar to hold a portion of said mount against a bottom face of said armrest bar.

* * * * *

UNITED STATES PATENT AND TRADEMARK OFFICE

CERTIFICATE OF CORRECTION

PATENT NO. : 5,944,387

DATED : August 31, 1999

INVENTOR(S) : William S. Stumpf

It is certified that error appears in the above-indentified patent and that said Letters Patent is hereby corrected as shown below:

In column 4, line 6, before "locking lever", insert ---a---.

In column 4, line 12, after "one" and before "said", insert ---of---.

Signed and Sealed this

Eighteenth Day of July, 2000

*Attest:*

Q. TODD DICKINSON

*Attesting Officer*

*Director of Patents and Trademarks*